US005238299A

United States Patent [19]

McKinney

[11] Patent Number: 5,238,299

[45] Date of Patent: Aug. 24, 1993

[54] ASSEMBLY TO INTRODUCE ELECTRIC CONDUCTORS INTO A REFRIGERATOR

[75] Inventor: Mark A. McKinney, Louisville, Ky.

[73] Assignee: General Electric Company, Louisville, Ky.

[21] Appl. No.: 881,348

[22] Filed: May 11, 1992

[51] Int. Cl.[5] ..... A77B 77/08

[52] U.S. Cl. ..... 312/223.6; 312/406; 174/153 G

[58] Field of Search ..... 312/406, 223.6, 223.1, 312/400; 174/65 G, 152 G, 153 G; 52/220, 221; 439/546, 547; 16/2; 248/56; 403/348

[56] References Cited

U.S. PATENT DOCUMENTS

| | | | |
|---|---|---|---|
| 1,094,990 | 4/1914 | Havens, Jr. | 174/152 G |
| 1,830,060 | 11/1931 | Holbrook | 312/406 X |
| 2,626,773 | 1/1953 | Backman | 411/349 X |
| 2,826,388 | 3/1958 | Janos et al. | 411/349 X |
| 3,042,471 | 7/1962 | Haslup | 174/152 G |
| 3,277,234 | 10/1966 | Dekko et al. | 16/2 X |
| 3,424,857 | 1/1969 | Miller et al. | 174/153 G |
| 3,619,482 | 11/1971 | Boor | 312/406 X |
| 3,778,529 | 12/1973 | Miller | 174/153 G |
| 4,097,096 | 6/1978 | Kochendorfer | 174/153 G X |
| 4,180,297 | 12/1979 | Abrams | 174/153 G X |
| 4,186,945 | 2/1980 | Hahn | 174/153 G X |
| 4,489,995 | 12/1984 | Burr | 312/223.6 |
| 4,797,513 | 1/1989 | Ono et al. | 174/153 G |
| 4,813,649 | 3/1989 | Takeda et al. | 403/348 X |

FOREIGN PATENT DOCUMENTS

| | | | |
|---|---|---|---|
| 218792 | 4/1958 | Australia | 312/223.6 |
| 1207370 | 7/1986 | Canada | 312/406 |

*Primary Examiner*—Rodney M. Lindsey

*Attorney, Agent, or Firm*—Radford M. Reams; H. Neil Houser

[57] ABSTRACT

An assembly for introducing electric conductors into the interior of a refrigerator through the liner. The liner is formed with a circular opening and a plurality of notches extending outwardly of the opening. A grommet has a central body portion with a circular cross-section encompassing the conductors. An annular flange and a plurality of mounting lugs project outward from the body. Each lug includes a locking portion spaced from the flange slightly more than the thickness of the liner and a connecting section joined to the flange. The grommet is mounted with its central body portion received in the opening in the liner and with the grommets received through the notches and rotated to capture a portion of the liner between the locking portion of the lugs and the flange.

5 Claims, 1 Drawing Sheet

ASSEMBLY TO INTRODUCE ELECTRIC CONDUCTORS INTO A REFRIGERATOR

BACKGROUND OF THE INVENTION

Modern day refrigerators (which includes combination refrigerator/freezers) have electrically operated devices in the refrigerated spaces. For example, typical refrigerators include one or more electric lamps which illuminate the interior when the doors are opened and many refrigerators include electrically operated ice makers and dispensing mechanisms of various kinds. All of the various electrically operated devices require that electric conductors or wires be routed to the interior of the liner. At the same time, modern refrigerators use foamed in place insulation filling the space between the liner and the outer cabinet of the machine. One approach has been to form the insulation and, after it has set-up, to pierce a hole through the insulation then thread electric wires through the hole and finally fill hole with an insulation material such as, for example, a material having the consistency of putty. This process is time consuming and labor intensive and does not assure uniformly good insulation around the conductors.

Another approach is to capture the wires in the central body portion of a molded grommet which has one or more threads around its outer edge. The grommet is then threaded in an opening in the liner before the insulation is formed. This assure good insulation and reduces the assembly time but is not entirely satisfactory. As an example, the threaded engagement between the grommet and liner requires the assembler to rotate the grommet through a significant angular distance. In addition, in some cases the wires conveniently should terminate in an electric connector structure which is captured or molded in the grommet. This prior art mounting makes it difficult to assure that the grommet is in the optimum orientation in the liner for connection to the molded-in connector.

Also it is necessary to pass the refrigerant conduit through the insulation layer so that it can connect the evaporator in the refrigerant system. U.S. Pat. No. 4,186,945, issued to Hahn and assigned to General Electric Company. Describes an assembly for this purpose. Hahn discloses a transition tube with a hollow central body having a plurality of locking tabs extending radially outward of the body. The locking tabs include camming faces which engage the outer cabinet as the tube is rotated. The tube also includes a plurality of stops offset relative to the locking tabs to positively locate the rotational position of the tube when it is mounted on the cabinet.

SUMMARY OF THE INVENTION

It is an object of this invention to provide an improved molded grommet assembly conducting electric conductors or wires into the inside of a refrigerator liner. It is a further object to provide such an improved assembly in which the grommet is positively mounted on the liner with a minimum of rotational movement. Yet another object is to provide such an improved assembly which facilitates positioning the grommet in the desired orientation on the liner.

In accordance with an illustrative embodiment of the present invention, there is provided a refrigerator with an inner liner and an outer cabinet or casing separated by a body of insulation. An assembly for introducing electric conductors or wires into the interior of the liner includes an opening in the liner and a cooperating grommet. The liner opening is generally circular and there are notches extending outwardly of the circular opening. The grommet includes a central body portion of generally circular cross-section. A flange and a plurality of mounting lugs project outwardly of the grommet body portion. Each lug includes a first portion spaced from the flange slightly more than the thickness of the liner and a second portion joining the first portion to the flange. The grommet is mounted to the liner with the body portion extending through the opening in the liner and with the lugs received through the corresponding notches and rotated so that the first portion of the lugs overlap the liner to position portions of the liner between lugs and the flange. The second portions of the lugs engage the edges of the liner defining the notches to positively position the grommet relative to the liner. Preferably the grommet is constructed as an unitary body of thermoplastic material such as polypropylene and closely encompasses the electric wires positioned in the central body portion. The wires may extend completely through the grommet or may terminate in an electric connector which is molded in the grommet body.

DESCRIPTION OF THE PREFERRED EMBODIMENTS

Figure 1:
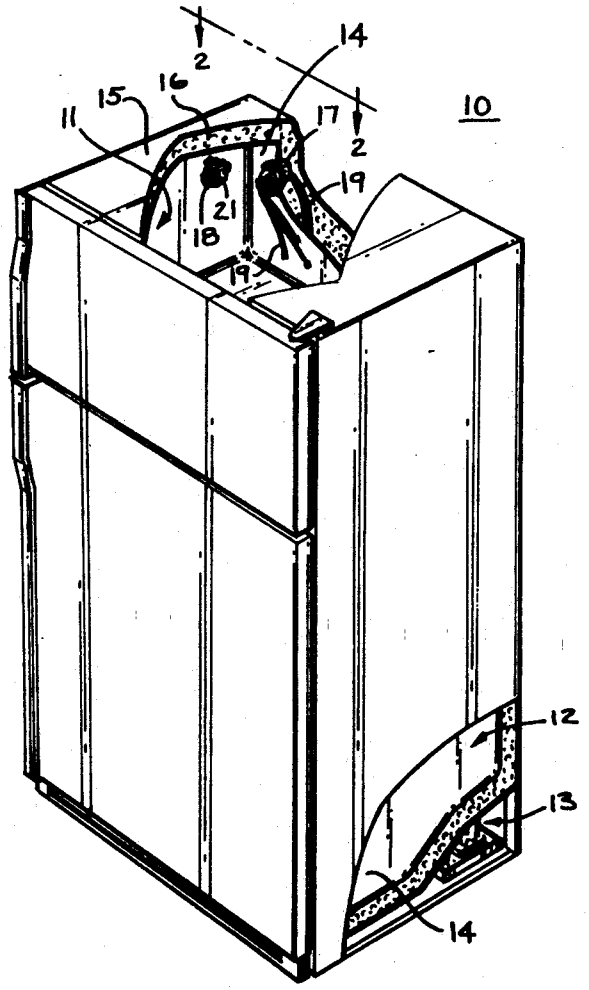
FIG. 1 is a somewhat schematic perspective view of a refrigerator/freezer type of refrigerator, the view being partly broken away and partly in section for purposes of illustration.
Figure 2:
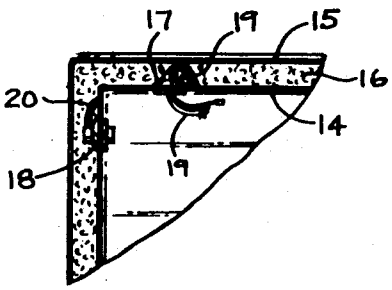
FIG. 2 is a fragmentary cross-sectional view generally as taken along line 2—2 in FIG. 1.
Figure 3:
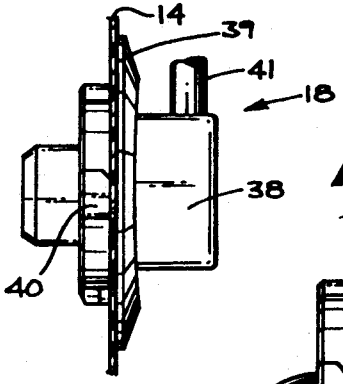
FIG. 3 is a fragmentary elevation view showing one of the grommets of FIG. 1 mounted to the liner.
Figure 5:
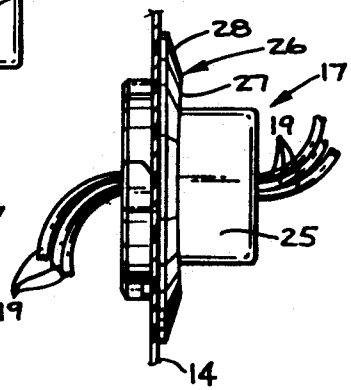
FIG. 5 is a fragmentary elevation view similar to FIG. 3 but illustrating the mounting of the other grommet of FIG. 1.
Figure 4:
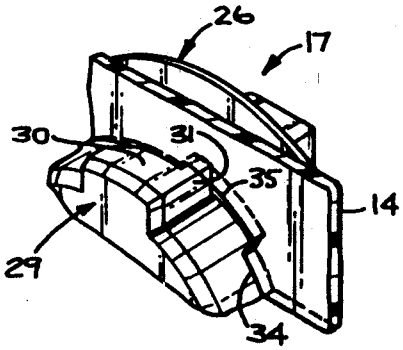
FIG. 4 is a fragmentary perspective view illustrating certain aspects of the grommet and liner mount of FIG. 3.
Figure 6:
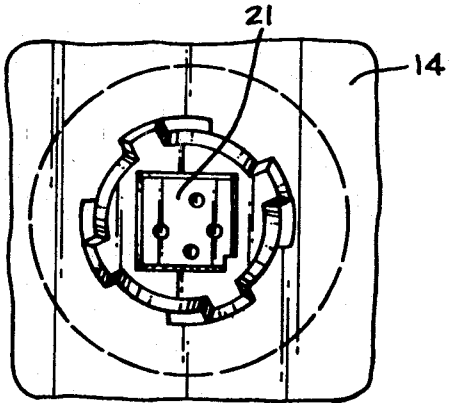
FIG. 6 is a fragmentary elevation view illustrating certain aspects of the grommet and liner mounting of FIG. 5.

While the present invention is applicable to any refrigerator with one or more refrigerated compartments for storing various foods and other items to be preserved, FIG. 1 illustrates a typical two compartment refrigerator. Refrigerator 10 includes an upper or freezer compartment 11 which is maintained at below freezing temperatures and a lower or fresh food storage compartment 12 which is maintained at cooled but above freezing temperatures. A machinery compartment 13 located below the fresh food compartment contains refrigerant condensing components of a suitable refrigeration system. One or more evaporator components of the refrigeration system are located within the cooled spaces to maintain the compartments at the desired temperatures. Such systems are well known in the art and one such system is described in U.S. Pat. No. 3,320,761, issued to Robert Gelbard and assigned to General Electric Company, the assignee of the present invention, to which reference is made for detailed description of various operating components.

The refrigerator 10 is constructed with an inner liner 14 which defines both the freezer and fresh food compartments and conveniently also may define a baffle (not shown) dividing them. An outer case or cabinet 15 surrounds and is spaced outwardly of the liner. The space between the liner and case, as well as the space between the freezer and fresh food compartments is filled with a body of insulation 16. Conveniently the insulation is foamed in place polyurethane. The front of the freezer and fresh food compartments are formed with access openings which are closed by doors 17 and 18 respectively As is well known in the art various operating components within the cooled compartments, such as lights controls, ice makers and dispensers for example, must be connected to the household electric system. In order to make this connection it is necessary to extend the electric wires or conductors through the body of insulation. However, the insulation forms a generally unitary body essentially completely filling the space between the liner and the cabinet. Installing the wires after the insulation is formed involves removal of a plug of insulation and refilling the void after the wires are inserted. This is time consuming and too often the space is not completely refilled with insulation. The wires may be installed before the insulation is foamed, however, this requires that the entry hole in the liner be sealed by a structure which will withstand the foaming pressure of the insulation without allowing foam to leak through its connection to the liner. In the past one such assembly included a grommet with one or more threads on its outer surface. The wires were molded into the grommet which then was screwed into an opening in the liner. This process required the assembler to twist the grommet through a large arc and made it difficult to both assure the grommet was fully seated against the liner and oriented as desired.

The present invention provides an improved assembly in which the grommet is fully seated with a minimum of turning and is assured of being in the desired orientation on the liner. FIG's 1 and 2 illustrate two similar grommets 17 and 18 respectively. As will be described in more detail hereinafter, the grommets differ in that the body of grommet 17 is straight while the body of grommet 18 includes an essentially right angled bend. Also the wires 19 pass completely through the grommet 17 while the wires 20 are connected to an electrical connector 21 which, in turn, is molded in the grommet 18. Both grommets 17 and 18 are shown in FIG's 1 and 2 for purposes of illustration. However, it will be understood that the grommets 17 and 18 are essentially alternate forms and normally only one grommet will be installed in the liner 13 at any one location.

Referring now more particularly to FIG's 3 and 4, the grommet 17 is formed as an unitary body molded of thermoplastic material such as polypropylene. The wires or conductors 19 are placed through the mold before the grommet is formed so that the wires are integrally molded in the central body portion 25 of the grommet and extend out of each end of the body portion. The body portion 25 is cylindrical in shape with a circular cross-section. A flexible annular flange 26 extends outwardly from the body 25 and includes a base portion 27 which is perpendicular to the body 25 and a peripheral portion 28 which inclines toward the inner end of body 25. A plurality of mounting lugs 29 extend outwardly from the body 25 adjacent the flange 26. Each lug includes a first or locking portion 30 which extends a few degrees around the outer surface of the body 25 and is spaced from the base portion 27 of the flange 26 slightly more than the thickness of the liner. Each lug also includes a second or connecting portion which joins the locking portion 30 to the base portion of the flange 26. While the particular number of mounting lugs is a matter of choice, I have found that four lugs spaced equal distances about the periphery of the central body 25 provides an effective assembly.

At the location in which it is desired to mount the grommet 17 the liner is formed with a generally circular opening 34 having a number of outwardly extending notches 35. There are the same number of notches as the grommet has mounting lugs, four in the illustrative assembly, and each notch is shaped to be complimentary to and slightly larger than the lugs. The inner end of the grommet, containing the lugs is inserted through the opening 34 from the outside or foam side of liner 14 until the lugs 29 are fully received in the notches 35. The grommet is then rotated or twisted slightly to bring the connecting portions 31 of the grommets into contact with the edges of the liner 14 defining the notches. This causes the locking portions 30 of the grommets to overlap the inner or refrigerated compartment side of the liner. Since the peripheral portion 28 of the flange 26 is inclined toward the lugs and in the unmounted configuration overlaps the mounting portion of the lugs, the flange engages the other side of the liner. This assures that the grommet is securely mounted on the liner and that the opening 34 is sealed against leakage of liquid foam. By mounting the grommet so that flange 26 is on the outside or foam side of the liner, the pressure generated by the insulation during the foaming process presses the flange even more tightly against the liner to prevent leakage of liquid foam. To this end the peripheral portion 28 of flange 26 preferably is slightly flexible.

In some instances it may be desired to terminate the electric wires in an electric connector at the grommet rather than have them extend into the fresh food or freezer compartment. For example, typically an ice maker is constructed as a separate sub-assembly and is then mounted in particular refrigerators. Such ice makers often include a male electric plug which is connected to a female connector located on the wall of the liner. To that end grommet 18 includes a female electric connector 21. Referring more particularly to FIG's 5 and 6, grommet 18 includes a generally cylindrical central body portion 38 having a circular cross-section, with a flange 39 and mounting lugs 40 projecting outwardly therefrom as with grommet 17. Rather than extending completely through the grommet, the wires or electric conductors 20 are connected to an electric connector 21 which, in turn, is molded in the central body portion and is accessible from the inner or lug end of the grommet. The end of grommet 18 opposite the connector is formed with an integral extension 41 extending perpendicularly from the body portion 38. The outer portion of wires 20 extend from the extension and are thus directed perpendicularly to the axis of body portion 38. The grommet 18 conveniently may be mounted in the liner in the same manner as previously described for grommet 17.

What is claimed is:

1. A refrigerator including an inner liner, defining a refrigerated space on one side of the liner, and an outer cabinet spaced apart from the other side of the liner to provide a space substantially filled with insulation and an assembly for introducing electrical wiring to the refrigerated space, including:

said liner being formed with a generally circular central opening therethrough with a plurality of notches extending outwardly of said opening and spaced apart from one another around said opening;

a grommet including a central body portion of generally circular cross-section and encompassing at least one electrical conductor extending therethrough; and annular flange having a base portion projecting outwardly of said central body portion and a plurality of mounting lugs projecting outwardly of said central body portion, each of said lugs including a first portion spaced from said base portion of said flange slightly more than the thickness of said liner and a second portion joining said first portion to said base portion of said flange, said flange also having a flexible peripheral portion inclined to overlap said first portions of said mounting lugs and said grommet being mounted with its central body portion extending through said central opening in said liner with said grommet flange on the insulation side of said liner and with each of said mounting lugs received through a corresponding notch and rotated to capture a portion of said liner between each of said lugs and the adjacent base portion of said grommet flange and to bring said peripheral portion of said grommet flange into engagement with said liner outside said central opening and notches.

2. A refrigerator as set forth in claim 1 wherein the second portion of each of said lugs is adapted to engage the edge of said liner forming the corresponding notch to limit rotational movement of said grommet within said opening.

3. A refrigerator as set forth in claim 1, wherein said grommet is formed as an unitary body of plastic resin.

4. A refrigerator as set forth in claim 3 wherein said central body portion of said grommet is molded about said at least one electric conductor.

5. A refrigerator as set forth in claim 4, wherein said at least one electric conductor is connected to an electric terminal device molded in said central body portion of said grommet.

* * * * *